US009961451B2

(12) United States Patent
Nicollini et al.

(10) Patent No.: US 9,961,451 B2
(45) Date of Patent: May 1, 2018

(54) DIFFERENTIAL-TYPE MEMS ACOUSTIC TRANSDUCER

(71) Applicant: STMicroelectronics S.r.l., Agrate Brianza (IT)

(72) Inventors: Germano Nicollini, Piacenza (IT); Silvia Adorno, Novate Milanese (IT); Andrea Barbieri, Casalpusterlengo (IT); Federica Barbieri, Milan (IT); Sebastiano Conti, Mistretta (IT); Edoardo Marino, Pero (IT); Sergio Pernici, Bergamo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 32 days.

(21) Appl. No.: 14/858,997

(22) Filed: Sep. 18, 2015

(65) Prior Publication Data

US 2016/0173992 A1 Jun. 16, 2016

(30) Foreign Application Priority Data

Dec. 15, 2014 (IT) ..... TO2014A1043

(51) Int. Cl.
*H04R 3/00* (2006.01)
*H04R 19/00* (2006.01)
(Continued)

(52) U.S. Cl.
CPC ..... *H04R 19/005* (2013.01); *H04R 19/02* (2013.01); *H04R 19/04* (2013.01);
(Continued)

(58) Field of Classification Search
CPC ..... H04R 19/005; H04R 2201/003; H04R 19/04; H04R 3/005; H04R 1/406;
(Continued)

(56) References Cited

U.S. PATENT DOCUMENTS

2007/0076904 A1* 4/2007 Deruginsky ..... H03F 1/3211 381/95
2009/0285412 A1 11/2009 Wu
(Continued)

FOREIGN PATENT DOCUMENTS

CN 202535535 U 11/2012
WO 2013/083203 A1 6/2013

OTHER PUBLICATIONS

Rombach et al., "The First Low Voltage, Low Noise Differential Silicon Microphone, Technology Development and Measurement Results," The 14th IEEE International Conference on Micro Electro Mechanical Systems, Jan. 2001, Interlaken, Switzerland, pp. 42-45.

*Primary Examiner* — Norman Yu
(74) *Attorney, Agent, or Firm* — Seed IP Law Group LLP

(57) ABSTRACT

A MEMS acoustic transducer has: a detection structure, which generates an electrical detection quantity as a function of a detected acoustic signal; and an electronic interface circuit, which is operatively coupled to the detection structure and generates an electrical output quantity as a function of the electrical detection quantity. The detection structure has a first micromechanical structure of a capacitive type and a second micromechanical structure of a capacitive type, each including a membrane that faces and is capacitively coupled to a rigid electrode and defines a respective first detection capacitor and second detection capacitor; the electronic interface circuit defines an electrical connection in series of the first detection capacitor and second detection capacitor between a biasing line and a reference line, and further has a first single-output amplifier and a second single-output amplifier, which are coupled to a respective one of the first detection capacitor and the second detection
(Continued)

capacitor and have a respective first output terminal and second output terminal, between which the electrical output quantity is present.

19 Claims, 4 Drawing Sheets

(51) Int. Cl.
*H04R 19/04* (2006.01)
*H04R 19/02* (2006.01)
*H04R 25/00* (2006.01)

(52) U.S. Cl.
CPC .... *H04R 2201/003* (2013.01); *H04R 2499/11* (2013.01); *H04R 2499/15* (2013.01)

(58) Field of Classification Search
CPC ..... H04R 31/00; H04R 2410/03; H04R 1/04; H04R 31/006; H04R 17/02; H04R 1/222; H04R 2410/01; H04R 25/407; H04R 3/00; H04R 3/007; H01L 2924/1461; H01L 27/20; H04S 2400/15; H04S 2420/11; G10K 11/1786; G10K 11/341
USPC ..... 381/355, 174, 175, 111, 113, 190, 26, 381/365, 369, 91, 93; 324/686, 658; 29/594
See application file for complete search history.

(56) References Cited

U.S. PATENT DOCUMENTS

2011/0255228 A1* 10/2011 Kimura ..... G01D 5/24 361/679.01
2012/0250881 A1* 10/2012 Mulligan ..... H03F 1/0261 381/92

* cited by examiner

DIFFERENTIAL-TYPE MEMS ACOUSTIC TRANSDUCER

BACKGROUND

Technical Field

The present disclosure relates to a MEMS (Micro-Electro-Mechanical System) acoustic transducer of a differential type.

Description of the Related Art

As is known, a MEMS acoustic transducer, for example a microphone of a capacitive type, generally comprises a micromechanical detection structure, which is designed to transduce acoustic pressure waves into an electrical quantity (in particular a capacitive variation), and an electronic reading interface, which is designed to carry out appropriate processing operations (amongst which amplification and filtering operations) on the same electrical quantity to provide an electrical output signal (for example, a voltage).

The micromechanical structure in general comprises a mobile electrode, provided as a diaphragm or membrane, arranged facing a fixed electrode, at a small distance of separation (the so-called "air gap"), for providing the plates of a detection capacitor with capacitance that is variable as a function of the acoustic pressure waves to be detected. The mobile electrode is generally anchored, by a perimetral portion thereof, to a fixed structure, whereas a central portion thereof is free to move, or undergo deformation, in response to the pressure exerted by the incident acoustic waves, thus causing a capacitance variation of the detection capacitor.

By way of example, FIG. 1 shows a micromechanical structure 1 of a MEMS acoustic transducer, of a known type, which comprises a structural layer, or substrate, 2 of semiconductor material, for example silicon, in which a cavity 3 is provided, for example via chemical etching from the back. A membrane, or diaphragm, 4 is coupled to the structural layer 2 and closes the cavity 3 at the top; the membrane 4 is flexible and, in use, undergoes deformation as a function of the pressure of incident acoustic waves.

A rigid plate 5 (generally known as "back plate") is arranged facing the membrane 4, in this case above it, via interposition of spacers 6 (for example, of insulating material, such as silicon oxide). The back plate 5 constitutes the fixed electrode of a variable-capacitance detection capacitor, the mobile electrode of which is constituted by the membrane 4, and has a plurality of holes 7, which are designed to enable free circulation of air towards the same membrane 4 (rendering the back plate 5 in effect "acoustically transparent").

The micromechanical structure further comprises (in a way not illustrated) membrane and rigid-plate electrical contacts, used for biasing the membrane 4 and the back plate 5 and acquiring a signal representing the capacitive variation that results from deformation of the membrane 4 caused by the incident acoustic pressure waves. In general, these electrical contacts are arranged in a surface portion of the die in which the micromechanical structure is made.

As is known, the sensitivity of the MEMS acoustic transducer depends, amongst other factors, upon the mechanical characteristics of the membrane 4 of the micromechanical structure, in particular upon its dimensions, for example in terms of surface area, and upon its electrical biasing.

Typically, the micromechanical structure of the MEMS acoustic transducer is charge-biased. In particular, a DC biasing voltage is applied, usually from a charge-pump stage (the higher this voltage, the higher the sensitivity of the microphone), and a high-impedance element (with impedance of the order of teraohms, for example between 100 GΩ and 100 TΩ) is inserted between the charge-pump stage and the micromechanical structure.

This high-impedance element is usually provided by a pair of diodes in back-to-back configuration, i.e., connected together in parallel, with the cathode terminal of one of the two diodes connected to the anode terminal of the other, and vice versa, or by a series of pairs of diodes once again in back-to-back configuration. The presence of this high impedance "isolates" the DC charge stored in the micromechanical structure from the charge-pump stage, at frequencies higher than a few hertz.

Since the amount of charge is fixed, an acoustic signal (acoustic pressure) that impinges upon the membrane 4 modulates the gap with respect to the back plate 5, producing a corresponding capacitive variation and a consequent voltage variation.

This voltage is detected by an electronic interface circuit with a high input impedance (in order to prevent the charge stored in the micromechanical structure from being perturbed) and then converted into a low-impedance signal (designed to drive an external load).

FIG. 2 shows a possible embodiment of the electronic interface circuit, designated by 10, in this case with single output, namely, a so-called "single-ended" circuit; the micromechanical structure 1 of the MEMS acoustic transducer is represented schematically as a detection capacitor 12 with capacitance $C_{MIC}$ that varies as a function of the acoustic signal detected.

The letter "m" designates, in FIG. 2 (and in the subsequent figures), the membrane 4 of the micromechanical structure 1. Given that, typically, the membrane 4 has a high parasitic capacitance in regard to the substrate 2 (comparable with the capacitance of the detection capacitor of the micromechanical structure itself), whereas the back plate 5 has a lower parasitic capacitance, the membrane 4 is electrically connected to a first low-impedance node $N_1$, for example to a ground operating voltage of the circuit, in order to prevent any attenuation of the signal, whereas the back plate 5 is electrically connected to a second node $N_2$, on which the detection signal that is indicative of the capacitive variations of the detection capacitor is acquired.

The second node $N_2$ is further electrically connected to a charge-pump stage (not illustrated herein), by interposition of a first isolating element 13, having a high impedance, constituted by a pair of diodes in back-to-back configuration, in order to receive a biasing voltage $V_{CP}$.

The interface circuit 10 further comprises a decoupling capacitor 14, having capacitance $C_{DEC}$, and an amplifier 15, in buffer or voltage-follower single-ended configuration (i.e., with the inverting input connected to the single output).

The decoupling capacitor 14 is connected between the second node $N_2$ and the non-inverting input of the amplifier 15, which further receives an operating voltage $V_{CM}$ from an appropriate reference-generator stage (not illustrated herein), via interposition of a second isolating element 16, with high impedance, constituted by a respective pair of diodes in back-to-back configuration.

The operating voltage $V_{CM}$ is a DC biasing voltage, appropriately chosen for setting the operating point of the amplifier 15. This operating voltage $V_{CM}$ is chosen, for example, in an interval comprised between a supply voltage $V_{DD}$ and the ground reference voltage. During operation of the MEMS acoustic transducer, the (AC) detection signal is thus superimposed on the DC operating voltage $V_{CM}$.

The amplifier 15 provides on the single output an output voltage $V_{OUT}$, as a function of the signal detected by the micromechanical structure 1 of the MEMS acoustic transducer.

This single-ended circuit configuration has some drawbacks, amongst which poor rejection in regard to any common-mode disturbance component, for example deriving from the supply noise or from crosstalk, due to near devices having time-varying signals.

In order to overcome the above drawbacks, the single-ended solution may be replaced by a differential configuration, which should theoretically afford a higher signal-to-noise ratio (SNR).

As illustrated in FIG. 3, the interface circuit 10 in this case comprises a so-called "dummy" capacitor 22, with capacitance $C_{DUM}$, having a nominal value equal to the value of capacitance at rest (i.e., in the absence of external stresses) $C_{MIC}$ of the detection capacitor 12 of the micromechanical structure 1.

Furthermore, the interface circuit 10 comprises a differential amplifier 25 with four inputs and two outputs, the so-called "fully balanced differential difference amplifier" (FDDA or FBDDA), having a fully differential architecture and a unity gain.

In particular, the second node $N_2$ of the detection capacitor 12 is in this case connected, via interposition of the decoupling capacitor 14, to a first non-inverting input 25*a* of the differential amplifier 25, a first inverting input 25*b* of which is directly connected in feedback mode to a first output terminal $Out_1$.

Likewise, the dummy capacitor 22 has a respective first node, designated by $N_1'$, connected to the ground terminal, and a second node $N_2'$ connected, via interposition of a respective decoupling capacitor 24, to a second inverting input 25*c* of the differential amplifier 25, a second non-inverting input 25*d* of which is further directly feedback-connected to a second output terminal $Out_2$ (output voltage $V_{out}$ is present between the first and second output terminals $Out_1$, $Out_2$).

The respective second node $N_2'$ of the dummy capacitor 22 further receives the biasing voltage $V_{CP}$ through a respective first isolating element 23, which is constituted by a pair of diodes in back-to-back configuration and receives the biasing voltage $V_{CP}$. Likewise, the second inverting input 25*c* receives the operating voltage $V_{CM}$, via a respective second isolating element 26, with high impedance, in the example also being constituted by a pair of diodes in back-to-back configuration (the operating voltage $V_{CM}$ is thus a biasing voltage common for the first non-inverting input 25*a* and the second inverting input 25*c* of the differential amplifier 25).

The dummy capacitor 22, in this case, enables creation of a substantially balanced path for the buffer inputs (i.e., the non-inverting input 25*a* and the inverting input 25*c*) of the differential amplifier 25, for a better common-mode rejection of the disturbance or noise.

Even though the differential configuration described with reference to FIG. 3 enables improvement of the disturbance rejection capacity, not even this makes it possible to increase the signal-to-noise ratio SNR as desired.

In general, the need is thus felt to provide an electronic interface circuit for a MEMS acoustic transducer enabling the signal-to-noise ratio (SNR) to be increased, without at the at the same time varying the sensitivity of the transducer, defined as the variation of voltage at output from the interface circuit, for an increase of the sound pressure level of 1 pascal (Pa). It should be noted that the latter characteristic implies that the signal generated by the MEMS acoustic transducer remains substantially the same, whereas the intrinsic noise of the same transducer is reduced, this being in general difficult to obtain, since MEMS sensors are generally designed to provide the maximum signal-to-noise ratio (SNR).

BRIEF SUMMARY

An aim of the present disclosure is to solve some or all of the problems highlighted previously, and to satisfy the aforesaid need, and in particular to provide a solution that will be simple and inexpensive to implement and will enable increase in the signal-to-noise ratio (SNR) of a MEMS acoustic transducer.

BRIEF DESCRIPTION OF THE SEVERAL VIEWS OF THE DRAWINGS

For a better understanding of the present disclosure, a preferred embodiment thereof is now described, purely by way of non-limiting example and with reference to the attached drawings, wherein.

DETAILED DESCRIPTION

A possible solution for increasing the signal-to-noise ratio of the MEMS acoustic transducer may envisage increase of the physical area of the transducer, i.e., the surface of the corresponding membrane and of the back plate. In fact, known statistical laws (here not discussed in detail) state that, in order to improve the signal-to-noise ratio (SNR) of an electronic component, its physical area may be increased accordingly.

For example, the signal-to-noise ratio (SNR) of a MEMS acoustic transducer of a capacitive type may be increased by approximately 3 dB by doubling the area of the corresponding membrane and of the corresponding back plate.

A possible solution may thus envisage "duplicating" or "doubling" the micromechanical structure of the MEMS acoustic transducer. However, in order to prevent problems of mechanical strength and consequent risks of failure, two micromechanical detection structures may be provided, each substantially similar to the micromechanical structure described with reference to FIG. 1, each consequently including a respective membrane 4, coupled to a respective back plate 5.

Figure 4:
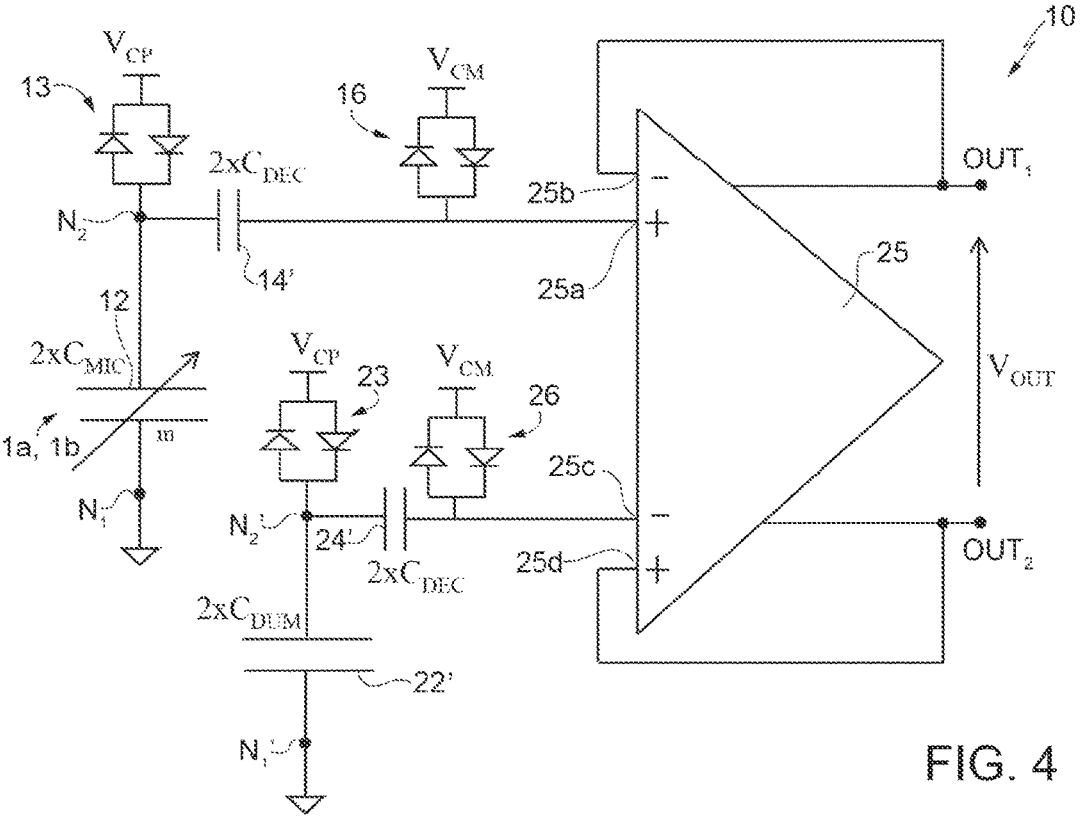
FIG. 4 is a circuit diagram of a further differential interface circuit for the MEMS acoustic transducer.

As illustrated schematically in FIG. 4, two micromechanical structures, here designated by 1*a* and 1*b*, which are substantially the same as one another as regards configuration and size, may thus be connected in parallel, and in particular the corresponding detection capacitors 12 may be electrically connected in parallel to one another (by electrical connections, for example wire connections, not illustrated in FIG. 4). Basically, the membranes 4 of the two micromechanical structures are electrically connected together, and likewise the back plates 5 of the two micromechanical structures are electrically connected together (the connection in parallel is schematically illustrated in FIG. 4 with the expression "2×" associated to the capacitance $C_{MIC}$).

The interface circuit illustrated in FIG. 4, designated once again by 10 (in general, elements similar to others already described previously are designated by the same references and are not described any further), is otherwise similar to the differential solution described with reference to FIG. 3, with the sole difference of envisaging consequent "doubling" also of the decoupling capacitors, here designated by 14', 24' and of the dummy capacitor, here designated by 22'.

Figure 3:
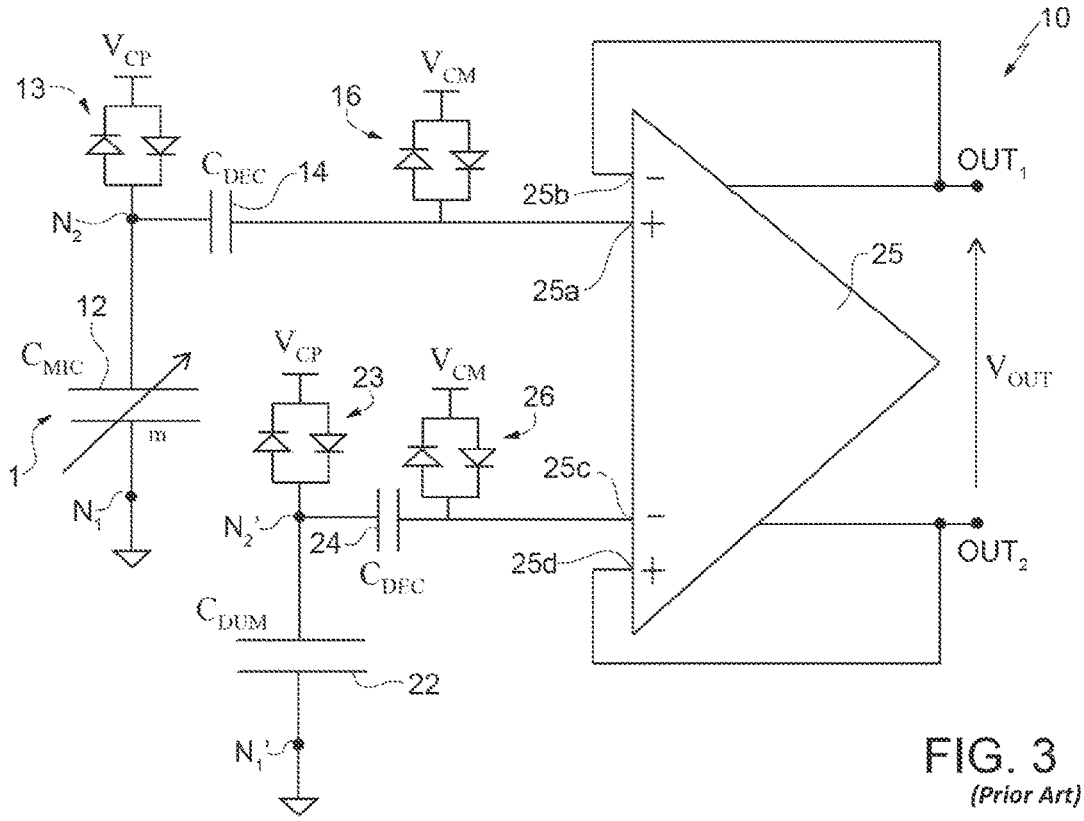
FIG. 3 (Prior Art)
FIG. 3 is a circuit diagram of a differential interface circuit, of a known type, of the MEMS acoustic transducer.

In the interface circuit 10, the amplitude of the detection signal is thus the same as in the traditional solution of FIG. 3, whereas the noise is decreased by a factor $\sqrt{2}$ (thanks to the aforementioned increase of the physical area occupied by the MEMS acoustic transducer). This solution enables increase of the signal-to-noise ratio of the MEMS acoustic transducer without jeopardizing the performance in terms of sensitivity.

This solution is not, however, free from drawbacks.

In the first place, the interface circuit 10 also in this case requires the presence of the dummy capacitor 22' in order to provide a differential system in association with the parallel of the detection capacitors 12 (which defines, in fact, in itself, a single-ended output). However, given that also the dummy capacitor 22' has to double its area, the resulting increase in area may be too high, at least for certain applications (for example, for portable electronic devices, where the reduction of the occupation of area is an important design parameter). In this regard, it is again emphasized that also the decoupling capacitors 14', 24' have doubled area.

Furthermore, the differential embodiment envisages, as previously discussed, use of a differential amplifier 25 with four inputs and two outputs, which is notoriously complex and costly to obtain. This type of amplifier has high distortion for input signals with high amplitude, and this results in the need to define a compromise between the distortion and the noise referred at input, unless a complex supplementary circuitry is used for dynamically biasing the input stage, as is known to persons skilled in the field (in this case, with further increase in the complexity of manufacturing, in electrical consumption levels, and in the occupation of area). Furthermore, the input capacitance of the amplifier 25 may not be sufficiently low to prevent attenuation of the signal, due to division with the capacitance $C_{MIC}$ of the detection capacitor 12.

Figure 5:
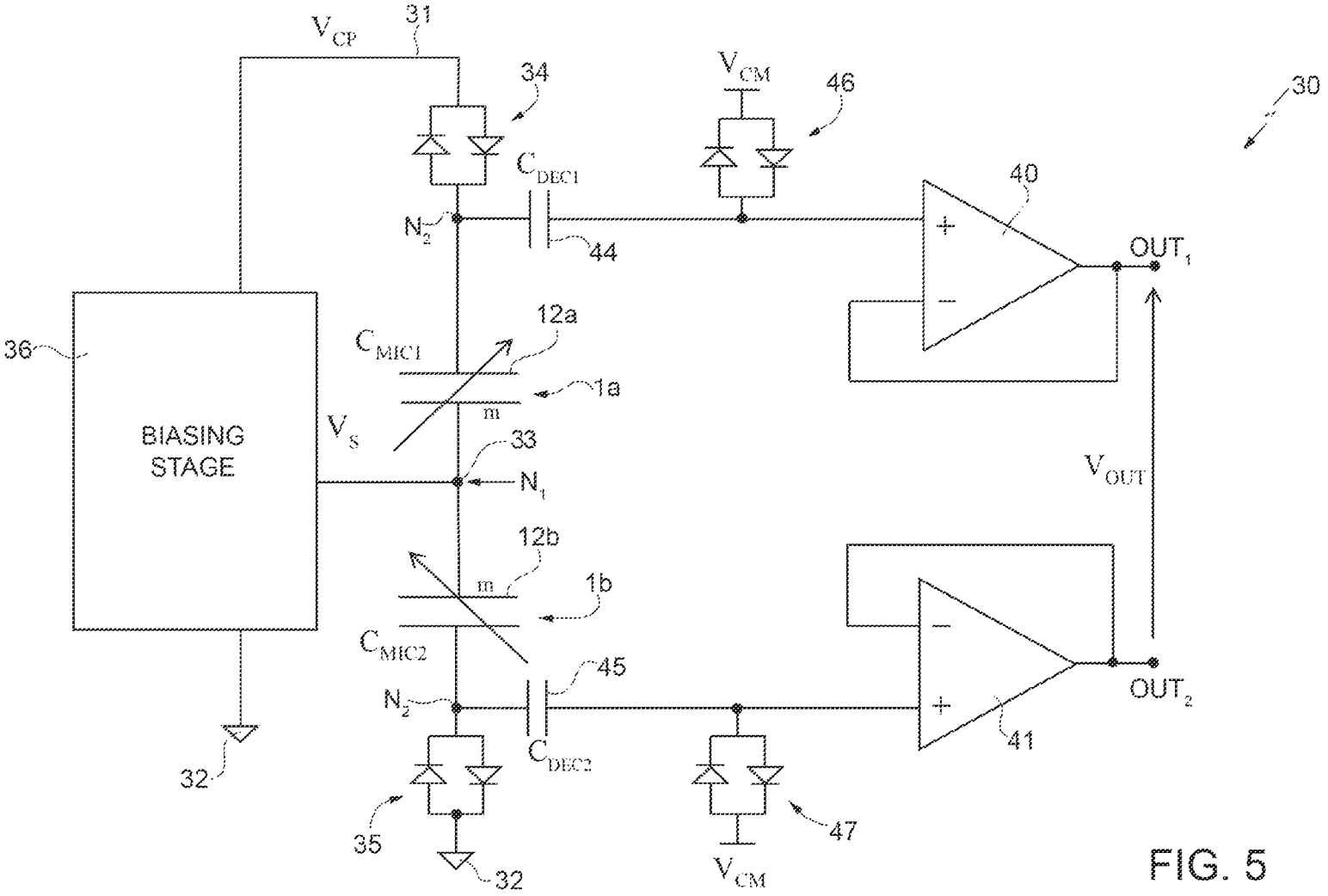
FIG. 5 is a circuit diagram of an interface circuit, with differential output, for the MEMS acoustic transducer, according to one embodiment of the present solution.

With reference to FIG. 5, an embodiment of the present solution is described, which enables the drawbacks listed previously to be overcome, at least in part.

In detail, the interface circuit, here designated by 30, of the MEMS acoustic transducer also in this case envisages "duplication" of the micromechanical detection structure into a first micromechanical structure 1*a* and a second micromechanical structure 1*b*, which are distinct from one another but correspond as regards configuration and size, in order to reduce (on account of the known effects discussed previously) the intrinsic noise thereof.

Figure 1:
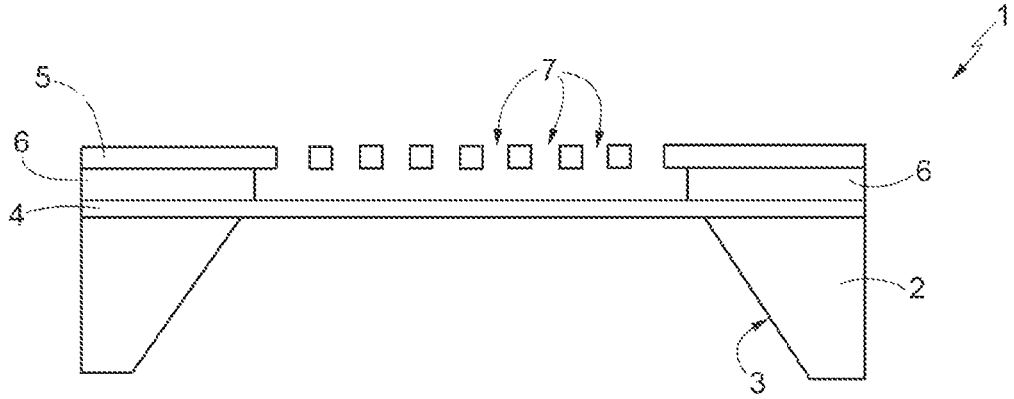
FIG. 1 (Prior Art)
FIG. 1 is a schematic cross-sectional view of a micromechanical structure of a MEMS acoustic transducer of a known type.
Figure 2:
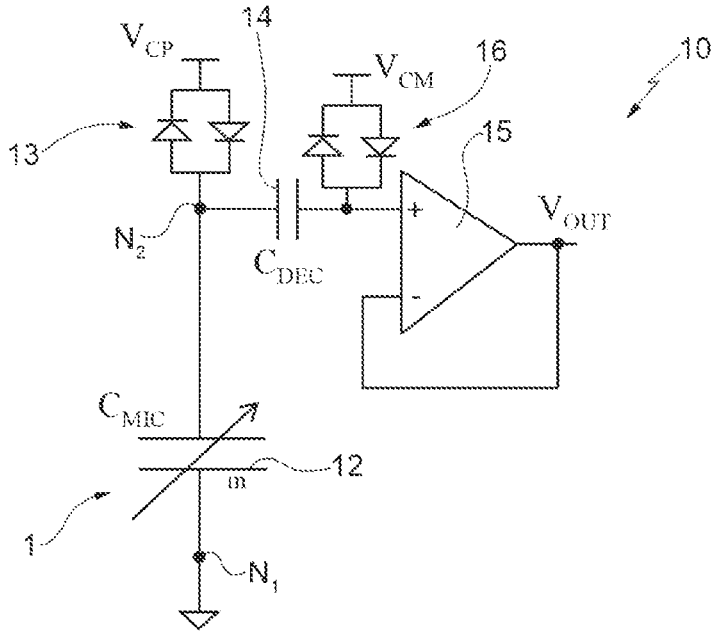
FIG. 2 (Prior Art)
FIG. 2 is a circuit diagram of a single-ended interface circuit, of a known type, of the MEMS acoustic transducer.

The interface circuit 30 thus envisages a first detection capacitor 12*a* and a second detection capacitor 12*b*, having capacitances $C_{MIC1}$ and $C_{MIC2}$, each associated to a respective micromechanical structure 1*a*, 1*b*, again provided in a way similar to what has been discussed with reference to FIG. 1, and thus comprising a respective membrane 4 and a respective back plate 5, advantageously provided on the same substrate 2 (and integrated in the same die of semiconductor material).

According to one aspect of the present solution, the first and second detection capacitors 12*a*, 12*b* are electrically connected together in series between a biasing line 31, which receives the biasing voltage $V_{CP}$ from a charge-pump stage (here not illustrated), and a (ground) reference-potential line 32.

In particular, the membrane 4 of the detection capacitors 12*a*, 12*b* are in the example electrically connected to one another. In other words, the first and second detection capacitors 12*a*, 12*b* have a respective first node $N_1$ electrically connected to a common node 33.

Furthermore, the second node $N_2$ of the first detection capacitor 12*a* is connected to the biasing line 31 through a high-resistance isolating element 34, for example constituted by a pair of diodes arranged in back-to-back configuration, and the respective second node $N_2$ of the second detection capacitor 12*b* is connected to the reference line 32 through a respective high-resistance isolating element 35, for example also this constituted by a pair of diodes arranged in back-to-back configuration.

According to one aspect of the present solution, the common node 33 is further set at a common voltage $V_S$, which constitutes a division of the biasing voltage $V_{CP}$, in particular being substantially equal to half of the biasing voltage, $V_{CP}/2$, so that both of the detection capacitors 12*a*, 12*b* have the same DC voltage drop between the corresponding membrane 4 and the corresponding back plate 5 (equal, that is, to $V_{CP}/2$).

In particular, the common voltage $V_S$ is supplied at output from a biasing stage 36, which is connected between the biasing line 31 and the reference line 32 and has a low output impedance at the operating frequencies of the interface circuit 30 and a low power consumption (so as not to jeopardize the current-driving capacities of the charge-pump stage that supplies the biasing voltage $V_{CP}$).

Figure 6:
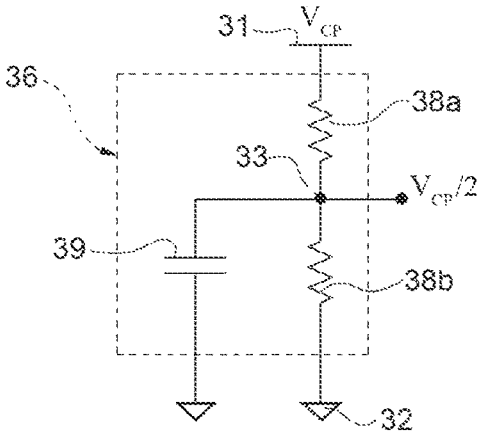
FIG. 6 shows a possible circuit embodiment of a biasing stage in the interface circuit of FIG. 5.

In a possible embodiment (illustrated in FIG. 6), the biasing stage 36 includes a resistive divider formed by a first voltage-division resistor 38*a* and a second voltage-division resistor 38*b*, connected in series between the biasing line 31 and the reference line 32, with common terminal connected to the common node 33. The first and second voltage-division resistors 38*a*, 38*b* have the same high resistance, for example of the order of tens of mega-ohms.

Furthermore, the biasing stage 36 comprises a respective decoupling capacitor 39, which is connected between the common node 33 and the reference line 32 and has, for example, a capacitance of some ten picofarads.

Advantageously, the voltage-division resistors 38*a*, 38*b*, given the high resistance, reduce the DC power consumption by the biasing line 31, whereas the decoupling capacitor 39 enables a low impedance at output from the biasing stage 36 to be obtained, at the operating frequencies of the interface circuit 30.

The interface circuit 30 (see again FIG. 5) moreover comprises a first amplifier 40 and a second amplifier 41, in buffer or voltage-follower single-ended configuration (i.e., with a single output and with the inverting input connected to the same single output; hereinafter these are referred to for brevity as "single-ended amplifiers"). The output voltage $V_{out}$ is present between the output terminals $Out_1$, $Out_2$ of the single-ended amplifiers 40, 41, the value of which is a function of the detection signal generated by the micromechanical structure of the MEMS acoustic transducer 1 in response to the external stresses.

In greater detail, the second node $N_2$ of the first detection capacitor 12*a* is connected to the non-inverting input of the first single-ended amplifier 40 via interposition of a decoupling capacitor 44, having a capacitance $C_{DEC1}$. Likewise, the respective second node $N_2$ of the second detection capacitor 12*b* is connected to the non-inverting input of the second single-ended amplifier 41 via interposition of a respective decoupling capacitor 45, having a capacitance $C_{DEC2}$.

Furthermore, the non-inverting inputs of the first and second single-ended amplifiers 40, 41 receive an operating voltage $V_{CM}$ from an appropriate reference-generator stage (here not illustrated), via interposition of a respective isolating element 46, 47, with high resistance, constituted by a respective pair of diodes in back-to-back configuration. As discussed previously, the operating voltage $V_{CM}$ is an appropriate DC biasing voltage, which sets the operating point of the single-ended amplifiers 40 and 41.

The interface circuit 30 thus provides a real differential configuration in so far as it supplies two single outputs, phase-shifted by 180° with respect to one another, the difference of which defines the output voltage ($V_{out}$).

In particular, on each detection capacitor 12*a*, 12*b* a DC biasing voltage is present, that is approximately half that of a traditional solution (for example, of the type discussed with reference to FIG. 3 or to FIG. 4), being in fact half the biasing voltage, $V_{CP}/2$. Consequently, the respective detection sensitivity, depending upon the DC biasing, is also halved.

However, due to the differential configuration, the output voltage $V_{OUT}$ is given by the difference of the detection signals supplied by the detection capacitors 12*a*, 12*b* (in the example at the corresponding back plates 5), so that at output a gain factor, or multiplication, is obtained, equal to two (it is emphasized in fact that the detection signals are mutually correlated and in phase opposition).

Furthermore, an appropriate increase in the value of the biasing voltage $V_{CP}$ may possibly be envisaged (for example, up to values in the region of 17 V-20 V), which, however, may easily be obtained by sizing the corresponding charge-pump stage.

Consequently, there is no substantial variation of the sensitivity at output from the MEMS acoustic transducer as compared to traditional solutions (given the same operating conditions and characteristics of the individual micromechanical detection structures).

At the same time, advantageously, a reduction of noise is obtained, and a corresponding increase of the signal-to-noise ratio (SNR). In fact, a reduction substantially by a factor of $\sqrt{2}$ is obtained of the noise generated in the MEMS acoustic transducer (the noise signals generated by the two micromechanical structures 1*a*, 1*b*, which have a value substantially half that of a traditional solution, are in fact altogether mutually uncorrelated at output).

The advantages of the solution proposed emerge clearly from the foregoing description.

In any case, it is emphasized again that the interface circuit 30 of the MEMS acoustic transducer provides a true differential output given by the difference of two detection signals in phase opposition, which has a sensitivity that is not worse than that of traditional solutions, but at the same time a lower intrinsic noise, in the example approximately 3 dB lower.

Furthermore, dummy capacitors are not required, nor doubling of area of the decoupling capacitors, with a consequent corresponding saving of area in the integrated implementation.

Nor is the use of a complex four-input operational amplifier required to carry out conversion between the single-ended output of the micromechanical detection structure and the differential output of the interface circuit, thus avoiding the associated harmonic distortions, which is the trade-off required between noise and signal attenuation. Simple single-ended operational amplifiers are in fact used.

The solution proposed does not envisage any modification to the manufacturing process or to the technology used for production of the MEMS acoustic transducer with respect to traditional solutions.

Figure 7:
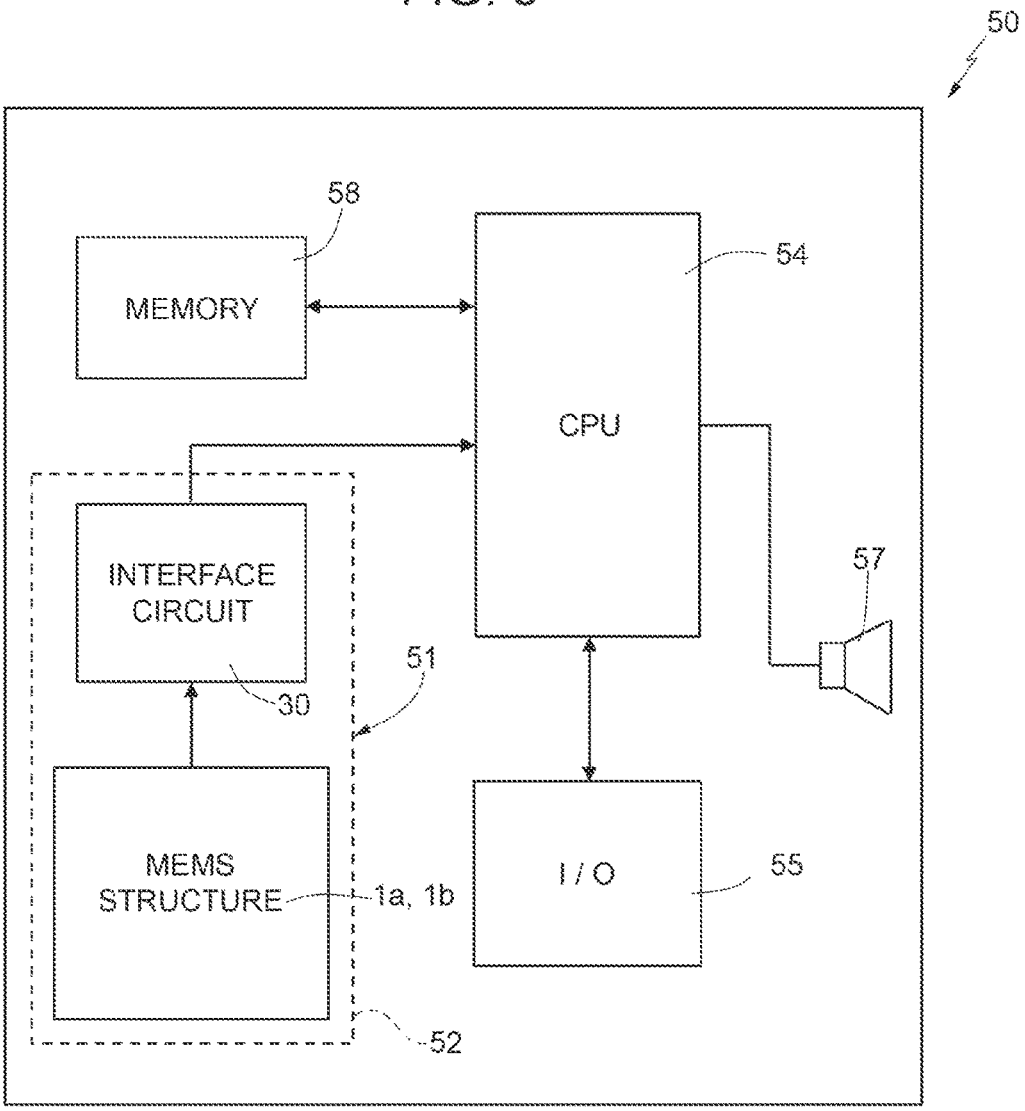
FIG. 7 is a schematic block diagram of an electronic device incorporating the MEMS acoustic transducer, according to one embodiment of the present solution.

The aforesaid advantages thus render the use of the MEMS acoustic transducer particularly advantageous in an electronic device 50, as illustrated schematically in FIG. 7. In particular, in FIG. 7, designated by 51 is the MEMS acoustic transducer, which includes, within the same package 52, the micromechanical detection structure, including the micromechanical structures 1*a*, 1*b*, and the interface circuit 30 that provides the corresponding reading interface (and that may be obtained in the same die where the micromechanical structure is provided or in a different die, which may in any case be housed in the same package 52).

The electronic device 50 is preferably a portable mobile-communication device, such as, for example, a mobile phone, a PDA (Personal Digital Assistant), a portable computer, but also a digital audio player with voice-recording capacity, a photographic camera or a video camera, a controller for videogames, etc.; the electronic device 50 is generally able to process, store, and/or transmit and receive signals and information.

The electronic device 50 further comprises a microprocessor 54, which receives the signals detected by the MEMS acoustic transducer 51, and an input/output interface 55, for example including a keypad and a display, connected to the microprocessor 55. Furthermore, the electronic device 50 may comprise a speaker 57 for generating sounds on an audio output (not shown), and an internal memory 58.

Finally, it is clear that modifications and variations may be made to what has been described and illustrated herein, without thereby departing from the scope of the present invention, as defined in the annexed claims.

In particular, different circuit embodiments may be envisaged for the biasing stage 36, which will in any case enable generation of the common voltage $V_S$, with appropriate value, and will have a low output impedance at the operating frequencies of the circuit, as well as a reduced power consumption.

Furthermore, the solution described may advantageously apply both to analog acoustic transducers and to digital acoustic transducers.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A MEMS acoustic transducer, comprising: a detection structure configured to generate an electrical detection quantity as a function of a detected acoustic signal, the detection structure including a first micromechanical structure of a capacitive type and a second micromechanical structure of a capacitive type, each of the first and second micromechanical structures including a membrane which faces and is capacitively coupled to a rigid electrode, the first and second micromechanical structures defining a respective first detection capacitor and second detection capacitor; and an electronic interface circuit coupled to the detection structure and configured to generate an electrical output quantity as a function of the electrical detection quantity, the electronic interface circuit defining an electrical connection in series of the first detection capacitor and second detection capacitor between a biasing line and a reference line, each of the membranes of the first and second micromechanical structures being directly connected to a common node and the electronic interface further including a first single-output amplifier and a second single-output amplifier coupled to a respective one of the first and second detection capacitors, and the first and second single-output amplifiers having a respective first and second output terminals, said the first and second single-output amplifiers configured to generate the electrical output quantity between the first and second output terminals.

2. The MEMS acoustic transducer according to claim 1, wherein the biasing line is set at a biasing voltage and the electrical connection in series of the first detection capacitor and second detection capacitor defines the common node; and wherein the electronic interface circuit further comprises a biasing stage configured to bias the common node at a common voltage that is a division of the biasing voltage.

3. The MEMS acoustic transducer according to claim 2, wherein the common voltage is equal to half of the biasing voltage.

4. The MEMS acoustic transducer according to claim 3, wherein the biasing stage is connected between the biasing line and the reference line and has an output connected to the common node, on which it supplies the common voltage.

5. The MEMS acoustic transducer according to claim 4, wherein the biasing stage includes a resistive divider configured to supply the common voltage on the common node, and a decoupling capacitor connected between the common node and the reference line.

6. The MEMS acoustic transducer according to claim 1, wherein each of the first amplifier and the second amplifier has a single-output single-ended configuration.

7. The MEMS acoustic transducer according to claim 6, wherein each of the first amplifier and the second amplifier has a buffer configuration, and have a respective non-inverting input coupled to a node of a respective one of the first detection capacitor and second detection capacitor, and an inverting input connected to the respective first output terminal and second output terminal.

8. The MEMS acoustic transducer according to claim 7, wherein the respective non-inverting input is connected to the terminal of the respective one of the first detection capacitor and second detection capacitor by interposition of a respective decoupling capacitor.

9. The MEMS acoustic transducer according to claim 1, wherein the first micromechanical structure and second micromechanical structure are integrated in a same die of semiconductor material.

10. The MEMS acoustic transducer according to claim 1, wherein the first micromechanical structure and second micromechanical structure of a capacitive type have matching configurations and dimensions.

11. The MEMS acoustic transducer according to claim 1, wherein the first detection capacitor is connected to the biasing line via a first resistive isolating element, the second detection capacitor is connected to the reference line via a second resistive isolating element, and a respective non-inverting input terminal of the first single-output amplifier and second single-output amplifier is connected to a line set at an operating voltage through a respective resistive isolating element.

12. An electronic device, comprising: a package including a MEMS acoustic transducer, the MEMS acoustic transducer including, a detection structure configured to generate an electrical detection quantity as a function of a detected acoustic signal, the detection structure including a first micromechanical structure of a capacitive type and a second micromechanical structure of a capacitive type, each of the first and second micromechanical structures including a membrane which faces and is capacitively coupled to a rigid electrode, the first and second micromechanical structures defining a first detection capacitor and second detection capacitor, respectively; and an electronic interface circuit including a biasing line and a reference line, the first detection capacitor and second detection capacitor connected in series between the biasing line and reference line, the membrane of the first detection capacitor being directly connected to the membrane of the second detection capacitors, and the electronic interface circuit configured to generate an electrical output quantity as a function of the electrical detection quantity, the electronic interface circuit further including a first single-output amplifier and a second single-output amplifier coupled to the first detection capacitor and second detection capacitor, respectively, and having a first output terminal and a second output terminal, respectively, configured to generate the electrical output quantity between the first and second output terminals; a processor coupled to the MEMS acoustic transducer; an input/output interface coupled to the processor; and a memory coupled to the processor.

13. The electronic device according to claim 12, wherein the electronic device comprises one of a mobile phone; a PDA (Personal Digital Assistant); a portable computer; a digital audio player with voice-recording capacity; a photographic camera; a video camera; and a videogame controller.

14. The electronic device of claim 12, wherein the MEMS acoustic transducer, processor, input/output interface and memory are integrated in a same die of semiconductor material.

15. A method, comprising:

sensing a change in capacitance of a first detection capacitor responsive to acoustic waves incident upon a first membrane plate of the first detection capacitor, the first detection capacitor further including a first back plate coupled to a biasing line;

sensing a change in capacitance of a second detection capacitor responsive to acoustic waves incident upon a second membrane plate of the second detection capacitor, the second detection capacitor further including a second back plate coupled to a reference line, and the first and second detection capacitors being coupled in series between the biasing line and the reference line and each of the first and second membrane plates being directly electrically coupled to a common node;

buffering a first voltage developed on the first back plate of the first detection capacitor to generate a first output voltage, the first output voltage varying as a function of the capacitance of the first detection capacitor;

buffering a second voltage developed on the second back plate of the second detection capacitor to generate a second output voltage, the second output voltage varying as a function of the capacitance of the second detection capacitor and the second output voltage being in phase opposition to the first output voltage; and sensing a differential voltage of the first and second output voltages to generate a differential output signal indicative of the magnitude of the incident acoustic waves.

16. The method of claim 15 further comprising:

biasing the first back plate at a first biasing voltage;

biasing the second back plate at a second biasing voltage that is less than the first biasing voltage; and biasing the common node at an intermediate biasing voltage.

17. The method of claim 16, wherein the intermediate biasing voltage is approximately halfway between the first and second biasing voltages.

18. The method of claim 17, wherein the intermediate biasing voltage is generated by dividing the first biasing voltage.

19. The method of claim 18, wherein dividing the first biasing voltage comprises resistively dividing the first biasing voltage.

* * * * *